United States Patent [19]

Boenitz

[11] Patent Number: 4,953,286

[45] Date of Patent: Sep. 4, 1990

[54] METHOD OF MAKING A TRANSFORMER CORE

[75] Inventor: Maurice J. Boenitz, Lenox, Mass.

[73] Assignee: Cooper Industries, Inc., Houston, Tex.

[21] Appl. No.: 299,927

[22] Filed: Dec. 12, 1988

[51] Int. Cl.[5] ..... H01F 41/02

[52] U.S. Cl. ..... 29/606; 29/609; 336/213; 336/218; 336/234

[58] Field of Search ..... 29/605, 606, 609; 336/234, 213, 218

[56] References Cited

U.S. PATENT DOCUMENTS 4,211,957 7/1980 Alley et al. ..... 336/213 X 4,482,402 11/1984 Taub ..... 29/605 X

*Primary Examiner*—Carl E. Hall

*Attorney, Agent, or Firm*—Elliott Cox; Eddie E. Scott; Nelson Blish

[57] ABSTRACT

Strips of cast amorphous metal material are folded to form segments of a transformer core. The segments are arranged in a stack or stacks that will ultimately become a transformer core. A single stack of folded segments is formed about a mandrel into the closed loop of a wound core. Two or more stacks of folded segments are arranged to form the closed loop of a stacked core. The stacks are annealed and the joints opened so that the stacks may be inserted into prewound windings. The joints are then reclosed to complete the transformer core-coil assembly.

3 Claims, 3 Drawing Sheets

METHOD OF MAKING A TRANSFORMER CORE

BACKGROUND OF THE INVENTION

1. Field of the Invention

The present invention is directed to electrical equipment and more particularly to an electrical transformer having a core produced from folded strips of amorphous metal material.

2. Background

The use of amorphous metal strips in electrical transformer cores is well known. For example, U.S. Pat. No. 4,734,975 to Donald E. Ballard and Willi Klappert assigned to General Electric Company discloses a Method of Manufacturing an Amorphous Metal Transformer Core and Coil Assembly. Amorphous alloy materials used in transformer cores are also disclosed in the group of U.S. Pat. Nos. 4,116,728; 4,262,233 and 4,528,481 issued to Joseph J. Becker, et al. and assigned to General Electric Company. While the use of amorphous metal material in transformer cores is well known, numerous problems have been encountered in such use and in the manufacture of such transformer cores.

Commercially available widths for amorphous metal strip are highly restricted. The vendors of amorphous metal strips want to cast the strip as wide as possible to minimize the cost of manufacturing the strip; however, there are practical limitations on the maximum width that can be cast. It has been suggested that in the foreseeable future the maximum width of strip will be about twelve inches. If a company wants a strip that is a "non standard size", the company will have to pay a premium price for that width. This imposes a restriction on the ability to design transformer cores from a variety of widths.

Amorphous metal strips are difficult to cut because they are hard and brittle. They are very abrasive and can damage mechanical cutting tools. Conventional mechanical cutting can produce irregular ends on laminations and can result in the material cracking and chipping. The cutting tool is rapidly dulled. Often chips are broken out of the cutting edge. Presently known alternative cutting methods for amorphous metal strips are slow and expensive.

DESCRIPTION OF OTHER PRIOR ART

In U.S. Pat. No. 4,668,931 issued to Maurice J. Boenitz and assigned to General Electric Company, a composite silicon steel—amorphous transformer core is described. Some of the difficulties in working with amorphous metal are described in the patent as follows: "Due to the nature of the manufacturing process, an amorphous ferromagnetic strip suitable for application in a laminated transformer core is extremely thin, normally 1–2 mils versus 7–12 mils for grain oriented silicon steel. Moreover, such amorphous steel strips are quite brittle and thus easily fractured. These characteristics render the processing of the amorphous strips into suitable core laminations and the subsequent handling thereof to build a transformer core a most difficult and rather costly procedure."

In U.S. Pat. No. 4,364,020 to K. C. Linn, et al. assigned to Westinghouse Electric Corporation two Amorphous Metal Cores are shown. Each lamination group of the cores has a layer of protective material surrounding the outermost lamination whereby each lamination group is protected from damage during handling.

In U.S. Pat. No. 4,506,248 to K. C. Linn, et al. assigned to the Electric Power Research Institute, a Stacked Amorphous Metal Core is shown. The stacked magnetic core is constructed from amorphous strip material. The legs and yokes of the core include first and second laminations formed from a non-amorphous magnetic strip material. The first and second laminations are spaced from one another to define a gap therebetween. Plurality of laminations formed from an amorphous magnetic strip material is stacked in the gap. Means are provided to join the first and second non-amorphous lamination so as to reinforce and support the core.

BRIEF DESCRIPTION OF DRAWINGS

For a better understanding of the nature and objects of the invention, reference should be made to the following detailed description of the invention taken in conjunction with the accompanying drawings, in which.

SUMMARY OF THE INVENTION

The present invention provides a practical and economical core for electrical transformers utilizing strips of amorphous metal material. The amorphous metal strips are folded to provide core laminations in a manner that reduces or simplifies cutting the strip. The amorphous metal strips are formed in desired core lengths and widths. The lengths and widths of the laminations are dictated by core geometry and core joint configuration. The amorphous metal is ductile enough to be bent or folded flat on itself before the anneal required to develop the desired magnetic properties in the core. The core joints can be opened, assembled into prewound electrical coils and the core joints reclosed. The foregoing and other features and advantages of the present invention will become apparent from a consideration of the following detailed description of the invention when taken in conjunction with the accompanying drawings.

DETAILED DESCRIPTION OF THE INVENTION

Figure 1:
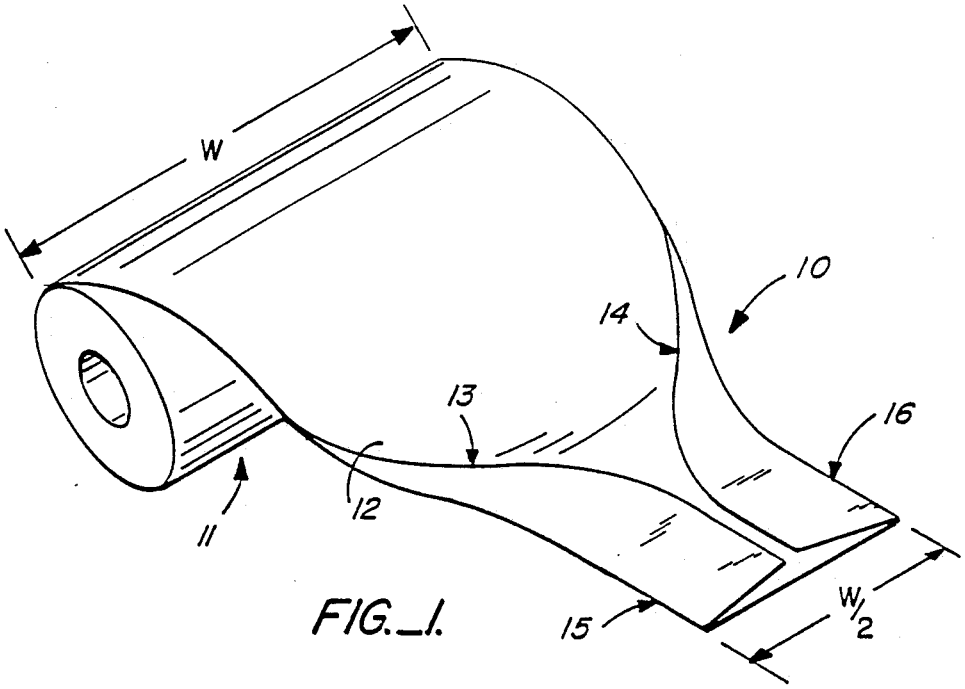
FIG. 1 is a pictorial representation illustration one embodiment of the folding of an amorphous metal strip.

Referring now to the drawings and in particular to FIG. 1, a system for folding an amorphous metal strip to form a section with a desired width is illustrated generally at 10. Suitable amorphous metal strip material is marketed by Allied Corporation of Morristown, New Jersey as its "METGLAS TYPE 2605-SC or 2605-SZ material". The amorphous metal sheet is contained in a roll 11. The roll has a width "W". The amorphous metal sheet 12 is unrolled and folded at points 13 and 14 thereby forming folds 15 and 16, respectively. Amorphous metal sheet 12 is folded back on itself, thereby providing a section that has a width of "one-half W".

The METGLAS material is very thin, nominally only about one mil in thickness, as compared to the usual 7 to 12 mil thickness of typical silicon steel laminations for distribution transformers. The thickness of the METGLAS material is more variable than the thickness of silicon iron. This causes problems in the design and manufacture of METGLAS cores. The thickness of the METGLAS strip could range plus or minus ten percent from nominal. The thickness of silicon iron varies less than plus or minus five percent from nominal The thickness of a METGLAS strip can vary along its length but most of the variation occurs across its width. In situations where the thickness is greater in the center, problems caused by the thickness variation can be minimized by folding the thinner edges 13 and 14 of the strip 12 toward the middle as shown in FIG. 1. This results in the final strip being half as wide as the cast strip.

Figure 2:
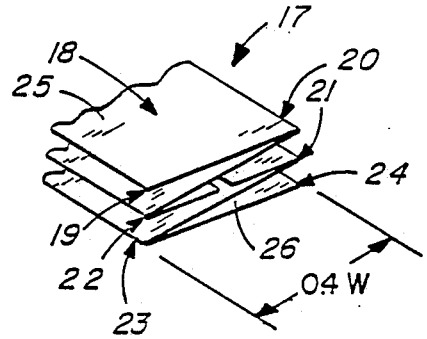
FIG. 2 illustrates folding two amorphous metal strips to obtain a four-tenths width section.

Other widths of transformer core sections can be obtained by folding the strip of amorphous metal longitudinally. As illustrated generally at 17 in FIG. 2, two strips 25 and 26 are placed together to form a section that is four-tenths the width of the original amorphous metal strip. The final section illustrated generally at 18 contains folds 20, 21, 22 and 23. Section 25 is folded with the two folds 20 and 22. Section 26 is folded with two folds 21 and 23. The end extending from fold 22 is only one-half the length of the section 18. The end extending from fold 21 is also only one-half the length of section 18. When the two pieces are placed adjacent each other as shown, they form a continuous amorphous metal strip.

Figure 3:
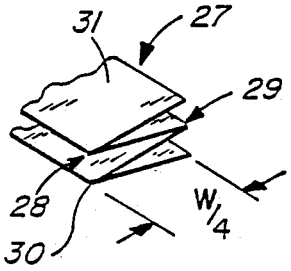
FIG. 3 illustrates folding an amorphous metal strip to obtain a one-fourth width section.

As illustrated generally at 27 in FIG. 3, a strip of amorphous metal material 31 is shown folded to form a section that is one-fourth the width of the original strip. Folds 28, 29 and 30 are formed longitudinally in the strip 31 dividing it into equal portions. The folded portions are compressed to form the amorphous metal strip section.

Figure 4:
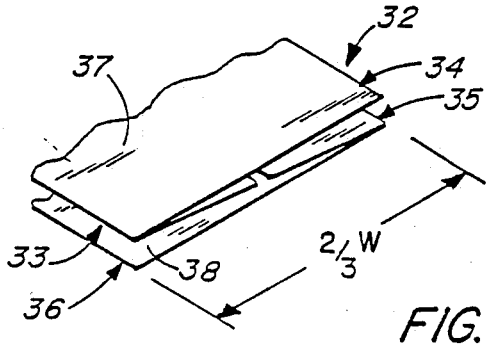
FIG. 4 illustrates folding two amorphous metal strips to obtain a two-thirds width strip.

Referring now to FIG. 4, the folding of two amorphous metal strips 37 and 38 and placing of the strips to form a final strip is illustrated at 32. The folding and placing together of the two amorphous metal strip 37 and 38 results in a final section that is two-thirds the width of the original cast strip. Strip 37 is folded at 33 leaving one section that is only one-half the width of the other section. The section 38 is folded at 35 leaving a section that is only one-half the remaining section. The two sections are placed as shown to form a section whose width is two-thirds the width of the original strip.

Figure 5:
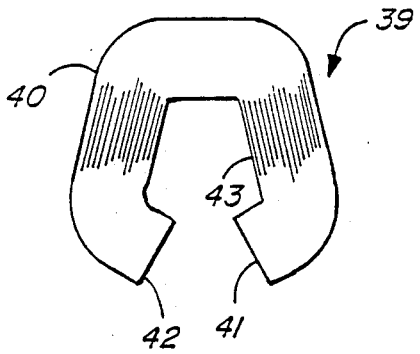
FIG. 5 illustrates a transformer core being opened to provide assembly of the windings.

Referring now to FIG. 5, a core of amorphous metal material is shown formed from the sections previously illustrated. The core 39 is made up of sections of amorphous metal material 40. The interior of the core 43 has been opened to allow windings (not shown) to be inserted. The end sections 41 and 42 are separated. Once the winding has been inserted, the transformer core is formed so that the end sections 41 and 42 abut each other.

Figure 6:
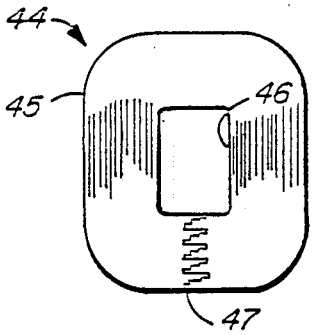
FIG. 6 illustrates the arrangement of a transformer core when it is closed.
Figure 7:
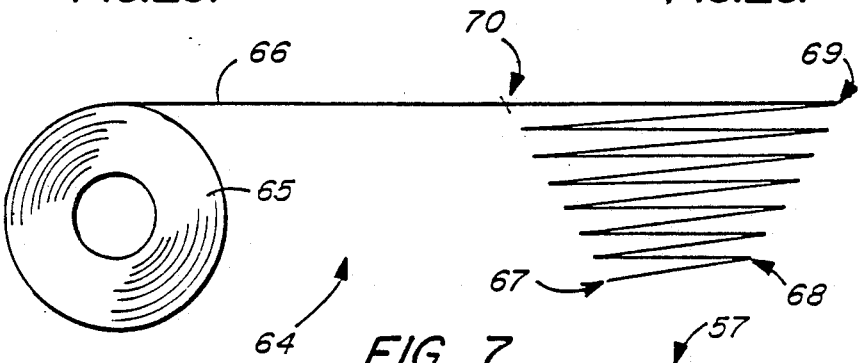
FIG. 7 illustrates the folding of a transformer core stack from a strip of amorphous metal.

Referring now to FIG. 6, another transformer core 44 constructed from strips of amorphous metal material is illustrated. The interior 46 will normally contain a winding (not shown). The end sections are formed to provide the staggered joint 47.

Figure 8:
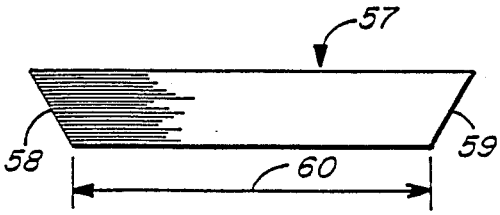
FIG. 8 is a side-view of a stack of folded laminations.
Figure 9:
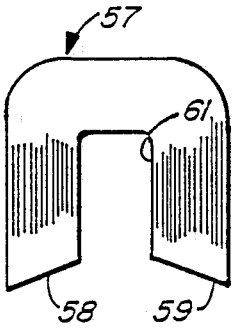
FIG. 9 illustrates the forming the core on an arbor from the stack of folded laminations shown in FIG. 8.
Figure 10:
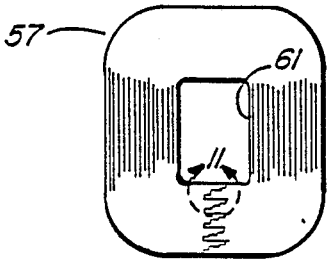
FIG. 10 shows a completely formed core from the stack shown in FIGS. 8 and 9.
Figure 11:
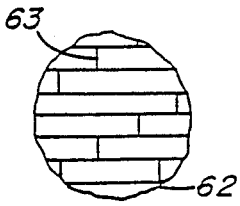
FIG. 11 is an enlarged view of the joining of the laminations.

Referring now to FIGS. 7–11, the formation of the core of an electrical transformer by folding a thin cast strip of amorphous metal alloy with minimal cutting of the strip is illustrated. A coil 65 contains the cast strip of amorphous metal material. The cast strip 66 is unrolled and folded across the casting direction to form a stack that will ultimately become the transformer core. The start end 67 of the stack and the first fold 68 will form the shortest section. The strip 66 is folded back and forth on itself in ever increasingly greater lengths until the last fold 69. The strip is then cut at 70. As shown in FIG. 8, stack 57 contains sloped and stepped ends 58 and 59. The entire stack is folded around an arbor as shown in FIG. 9. The arbor determines the inner opening 61. As illustrated in FIG. 10, the stepped folded ends 58 and 59 are folded inward to form the completed transformer core 57. The stepped ends 58 and 59 are joined by the joints shown in greater detail in FIG. 11. The individual sections 62 and 63 meet to form stepped butt joints.

Figure 12:
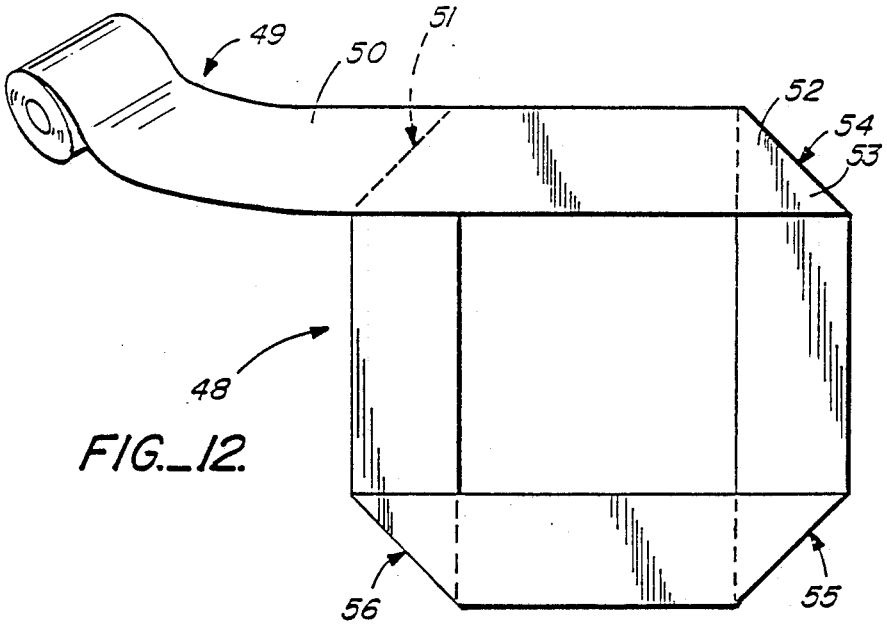
FIG. 12 illustrates the forming of a transformer core wherein the amorphous metal strip is folded at 45 degrees.

Referring now to FIG. 12, a strip of amorphous metal 49 is formed into a section 48 that is the shape of a transformer core by being folded at 45°. The strip is folded at folds 54, 55 and 56. The angles 52 and 53 are forty-five degree angles. The strip 50 will then be folded at 51 or cut at 51. The section 48 can be stacked. If the core is formed by continuous folding, spaces between sections can be filled with short strips to avoid air spaces. A somewhat analagous stamping arrangement of iron core material is illustrated in U.S. Pat. No. 614,474 issued Nov. 22, 1898.

FIGS. 1–14 show folding an amorphous metal strip into core segments. The laminations are formed or stacked into the desired core configuration and annealed to relieve residual stresses. The joints of the core can be formed as stepped-lap joints or butted and lapped joints or other forms of joints. The advantage of folding the strip rather than cutting it, lies in the desirability of maximizing the length between cuts and minimizing the number of cuts of the strip because of the difficulty of cutting the brittle amorphous metal alloy material. Various embodiments of the folded amorphous metal alloy lamination are disclosed, including embodiments in which the strip of amorphous metal alloy is folded in the longitudinal direction (direction of the cast) and where the strip is folded at an angle with respect to the longitudinal axis of the strip, e.g., at 45 degrees and 90 degrees.

The use of folded amorphous metal laminations reduces the number and/or length of cuts that have to be made to make a stack of laminations. The cutting of amorphous metal material is relatively slow. A reduction in the number of cuts provides an advantage in the time required for manufacture. The thickness of amorphous metal material is more variable than the thickness of iron material used for transformer cores. This causes problems in the design and manufacture of amorphous metal cores.

The thickness of an amorphous metal strip can vary along its length but most of the variation occurs across its width. The problems caused by the thickness variation are minimized by folding the edges of the strip towards the middle in such a manner that the strip is only a fraction as wide as the cast strip. The strip can be folded in such a manner that the width of the transformer lamination is a proportion of the cast width.

Figure 13:
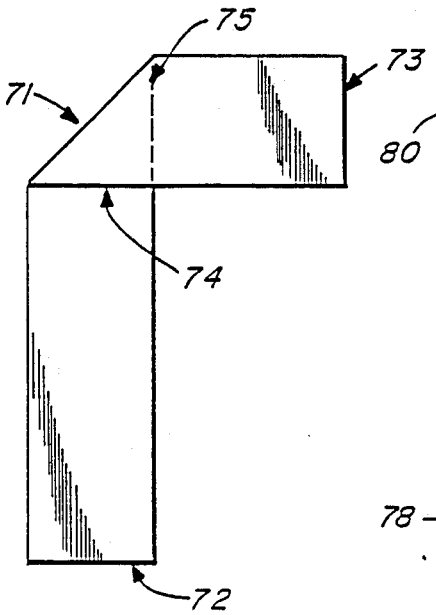
FIG. 13 illustrates the folding of an amorphous metal strip at 45 degrees and 90 degrees to form an L shaped transformer core segment.

Referring now to FIG. 13, a strip of amorphous metal is formed into the general L shape of a core segment by being folded 45 degrees at section 71, and across the casting direction at sections 72 and 73. The cut ends of the amorphous metal strip are pulled back in the casting direction and abut the cast edges of the strip at sections 74 and 75.

Figure 14:
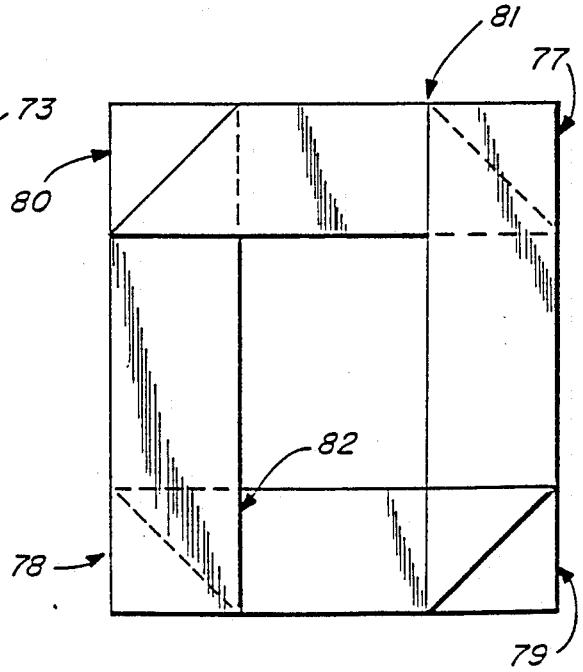
FIG. 14 illustrates the stacking of the L shaped transformer core segments of FIG. 13 into a closed loop stacked transformer core.

Referring now to FIG. 14, a stacked core of amorphous metal material is shown formed from a plurality of segments illustrated in FIG. 13. Each layer of the stack consists of two L shaped segments illustrated in FIG. 13, arranged so that the folded end 73 of FIG. 13 abuts the inside double edge of the longer leg. This is shown at sections 81 and 82 of FIG. 14. The 45 degree folds of the top two segments are therefore located in the upper left and lower right hand corner of the roughly rectangular frame formed by the L shaped segments. Each layer is rotated 180 degrees from the proceeding layer to form a stack with no gaps in the legs or yokes. Gaps between the core segments are present only in the outer corner regions of the stack.

It will be readily observed from the foregoing detailed description of the invention and from the illustrated embodiment thereof that numerous variations and modifications may be effected without departing from the true spirit and scope of the novel concepts or principles of this invention. This invention is susceptible of embodiment in many different forms, this specification and the accompanying drawings disclose only a few specific forms of the invention. The invention is not intended to be limited to the embodiment so described, and the scope of the invention will be pointed out in the appended claims.

The embodiments of an invention in which an exclusive property or privilege is claimed are defined as follows:

1. A method of producing a transformer core, comprising:

providing a strip of amorphous metal material having a length with a longitudinal axis and a width, wherein said length is substantially greater than said width;

folding said strip of amorphous metal material along a line parallel to said longitudinal axis;

forming a core segment or segments from the folded strip of amphorous metal material;

arranging the segment or segments in the shape of a transformer core; and annealing the segment or segments.

2. A method of producing a transformer core comprising the steps of:

providing a length of amorphous metal material having a longitudinal axis, folding said length of amorphous metal material along a line parallel to said longitudinal axis;

forming at least one core segment from the folded length of amorphous metal material, arranging the segment in the shape of a transformer core, and annealing the segment.

3. A method of producing a transformer core comprising:

providing a strip of amorphous metal material having a length and a width, wherein said length is substantially greater than said width;

folding said strip of amorphous metal material lengthwise, forming a core segment having a width that is a fraction of the width of the original strip from the folded strip of amorphous metal material, and utilizing the segment in the production of a transformer core.

* * * * *